United States Patent [19]

Noyce

[11] 3,983,732

[45] Oct. 5, 1976

[54] SPRING FORMING MACHINE

[75] Inventor: George Noyce, Placentia, Calif.

[73] Assignee: Hartwell Corporation, Placentia, Calif.

[22] Filed: June 12, 1975

[21] Appl. No.: 586,210

[52] U.S. Cl. ..... 72/131; 72/137; 140/102

[51] Int. Cl.[2] ..... B21F 3/027

[58] Field of Search ..... 140/71, 102, 105; 72/131, 137

[56] References Cited

UNITED STATES PATENTS

| | | | |
|---|---|---|---|
| 3,048,199 | 8/1962 | Barnes | 140/71 |
| 3,227,195 | 1/1966 | Stegmann | 140/71 |

*Primary Examiner*—Lowell A. Larson
*Attorney, Agent, or Firm*—Lyon & Lyon

[57] ABSTRACT

A spring forming machine including an inclined bed structure provided with a front side having circular mounting channels surrounded by a ring of access openings, each surrounded by screwthreaded mounting sockets or perforations, and provided with a back side on which is mounted a main drive gear accessible through the openings. The mounting sockets support a variety of tool operating units each having a drive means extending through a selected clearance opening and terminating in a planetary gear engageable with the main drive gear. The mounting channels support separately, or in conjunction with the mounting sockets, a variety of wire forming tool components which are driven by corresponding tool operating units. The main drive gear also operates a wire feeding apparatus offset laterally from the bed structure.

18 Claims, 18 Drawing Figures

FIG. 4.
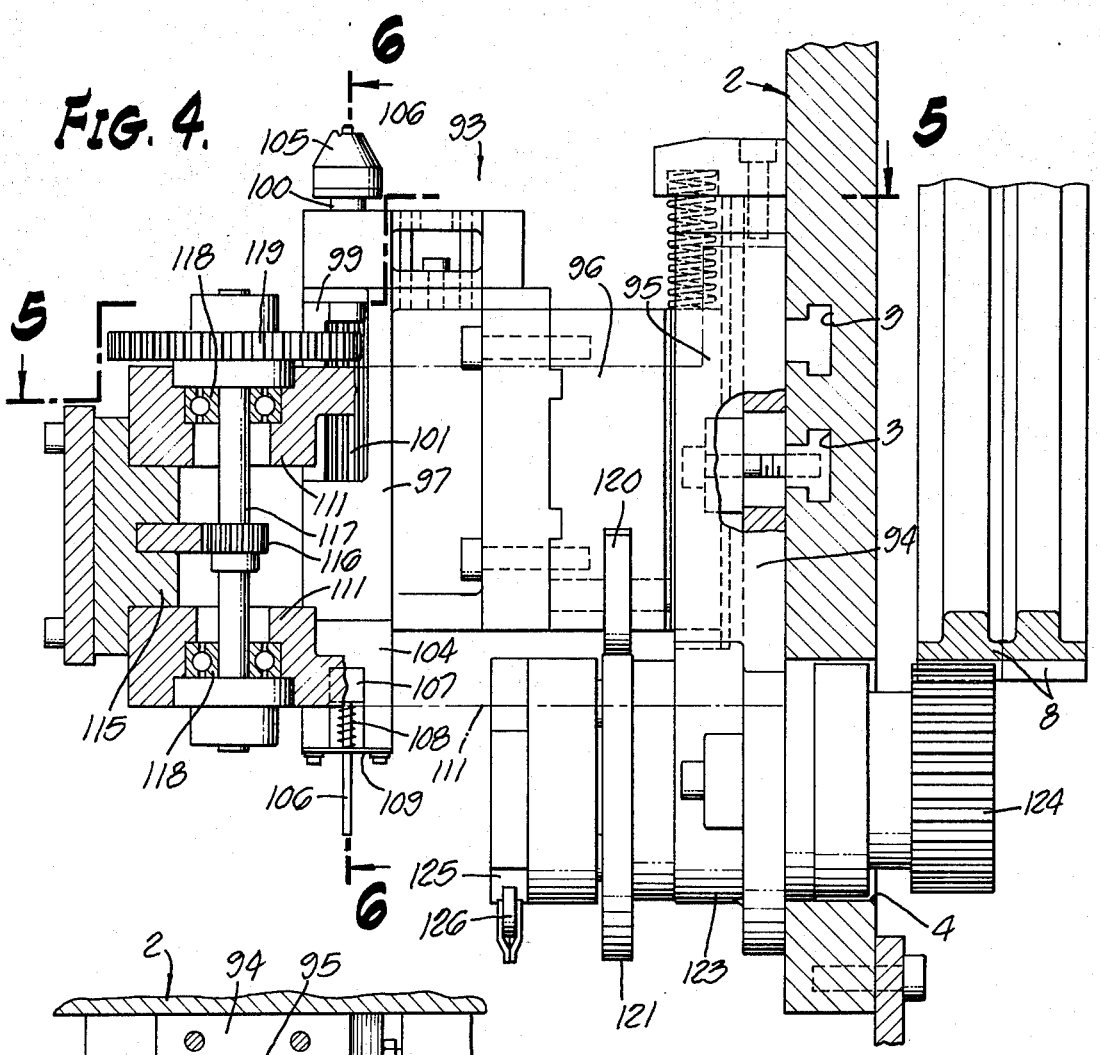
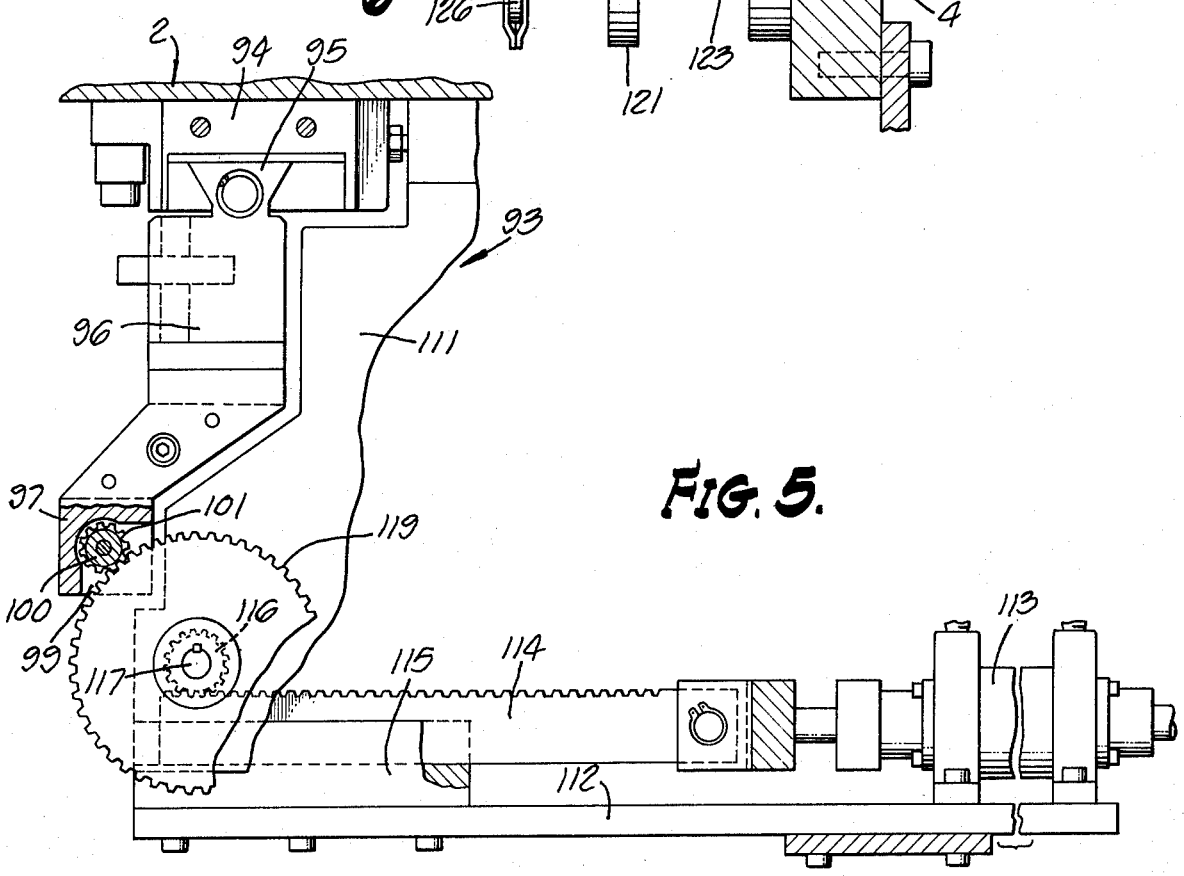
FIG. 5.

FIG. 10.
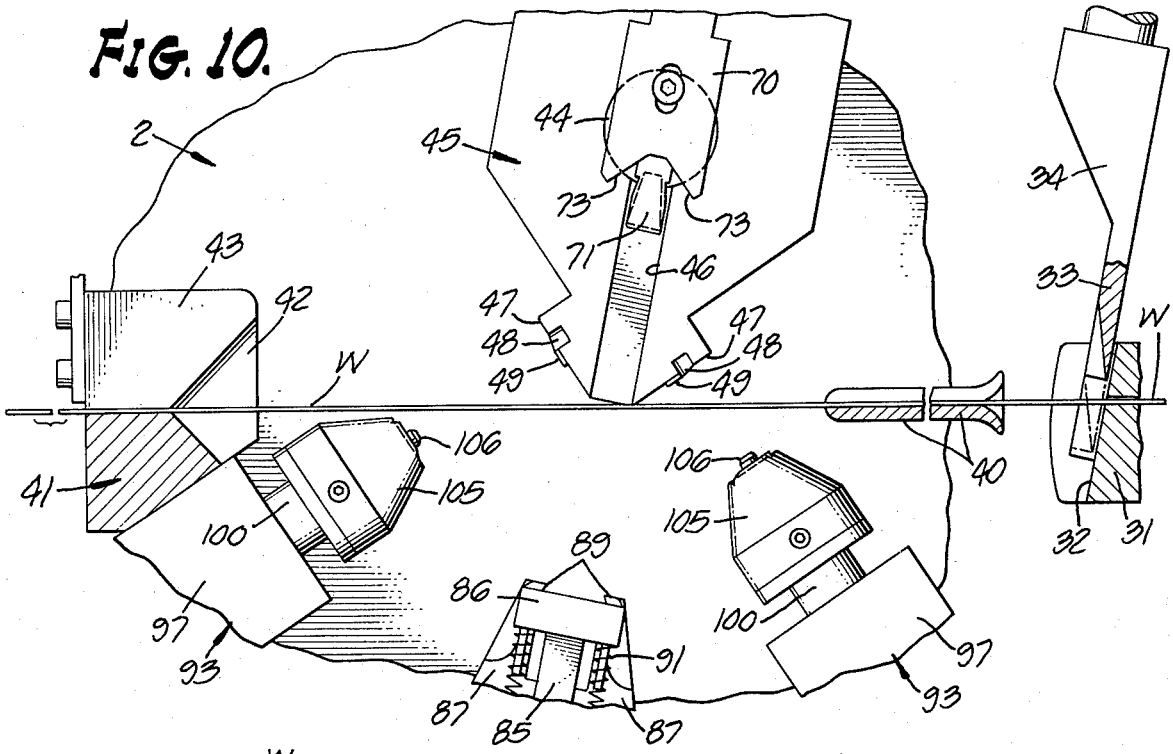
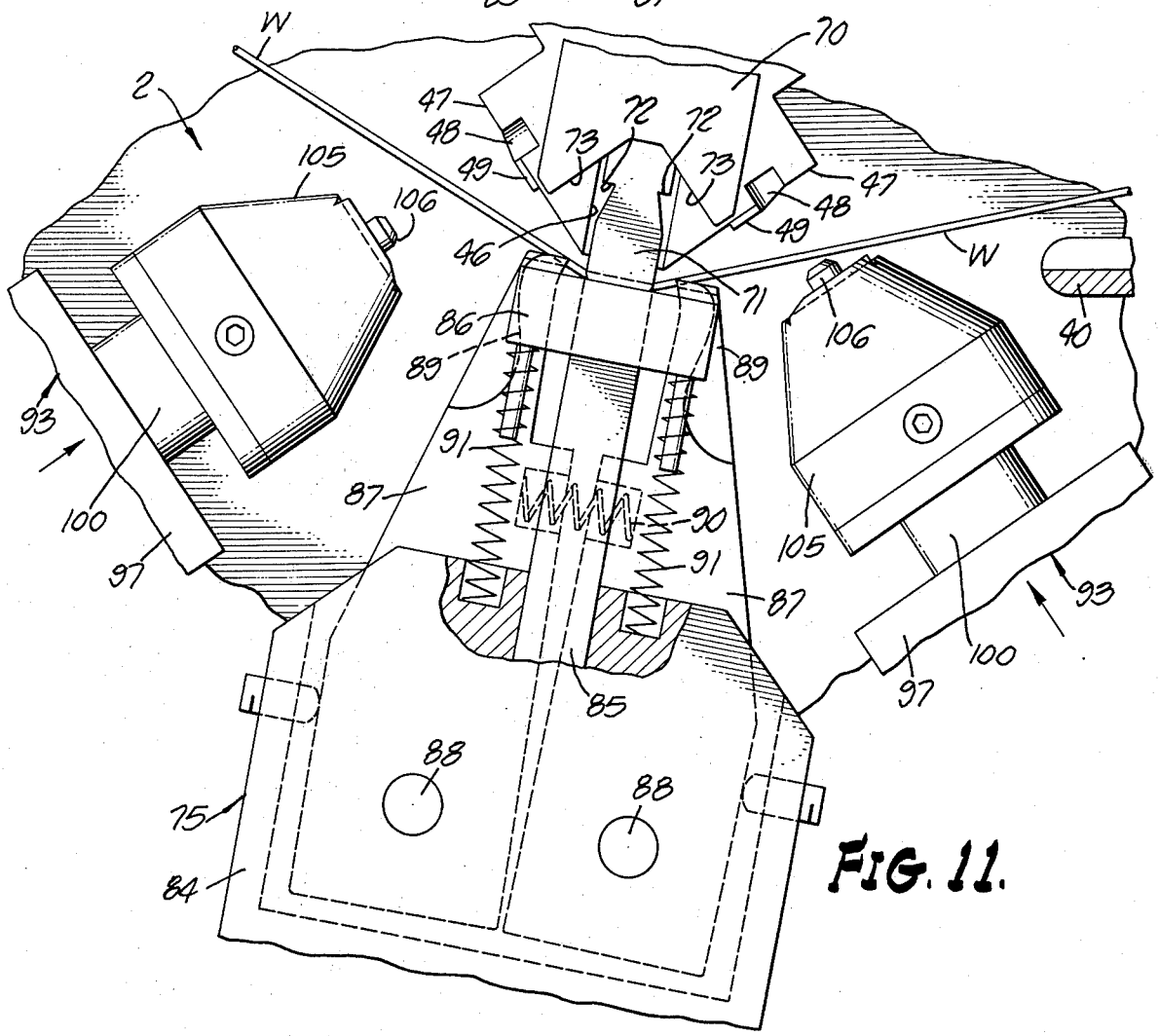
FIG. 11.

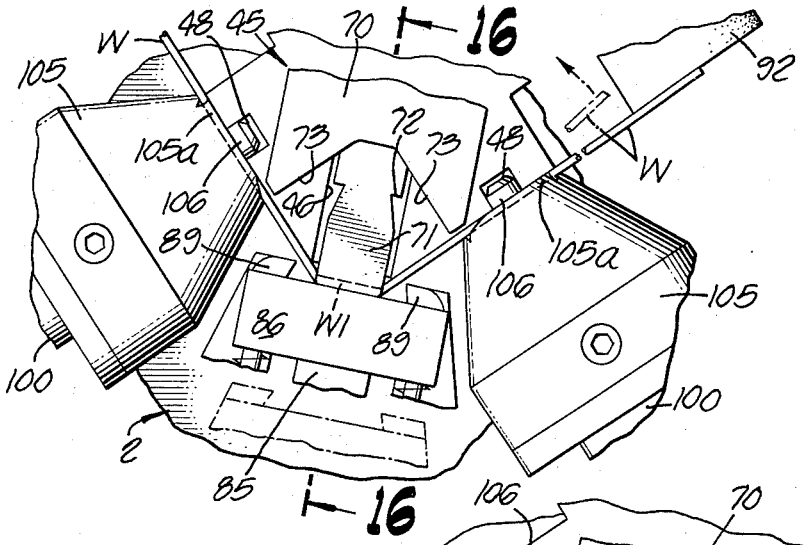
FIG. 12.
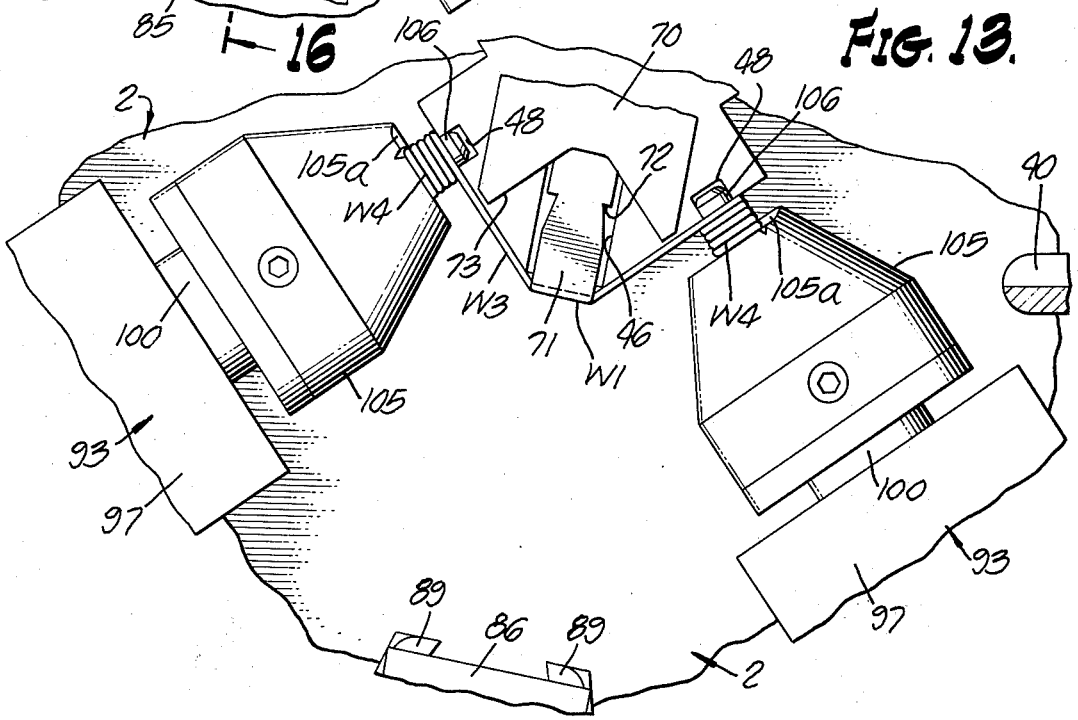
FIG. 13.
FIG. 14.
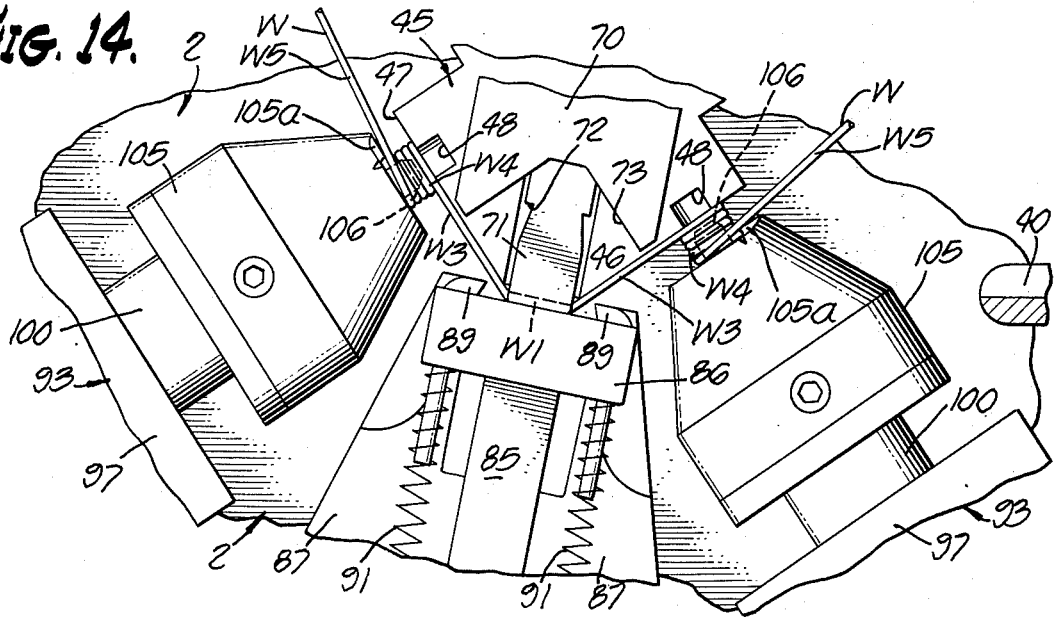

FIG. 15.
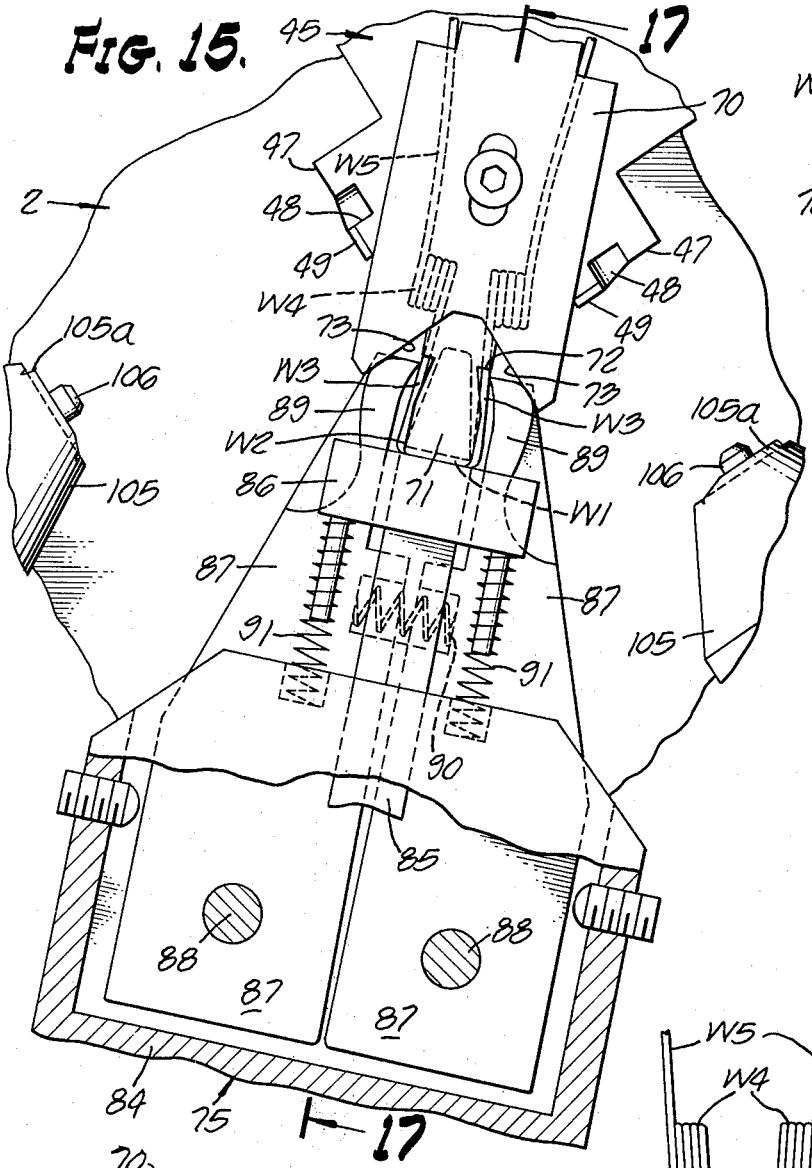
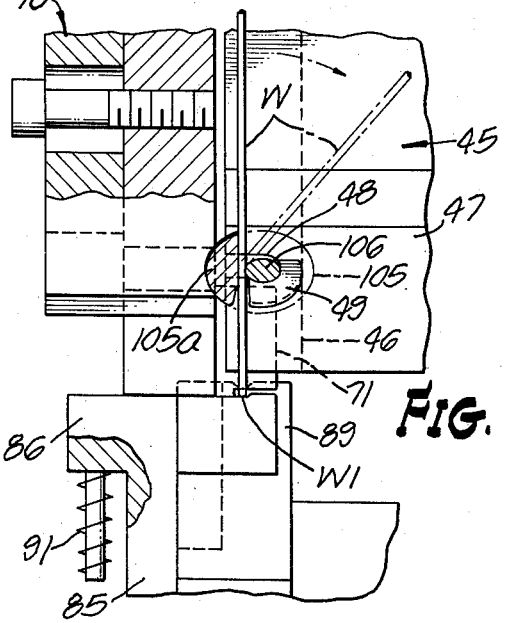
FIG. 16.
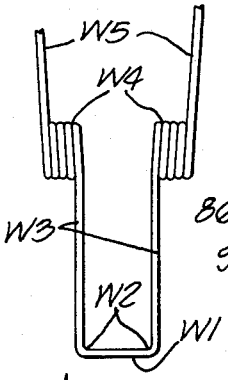
FIG. 18.
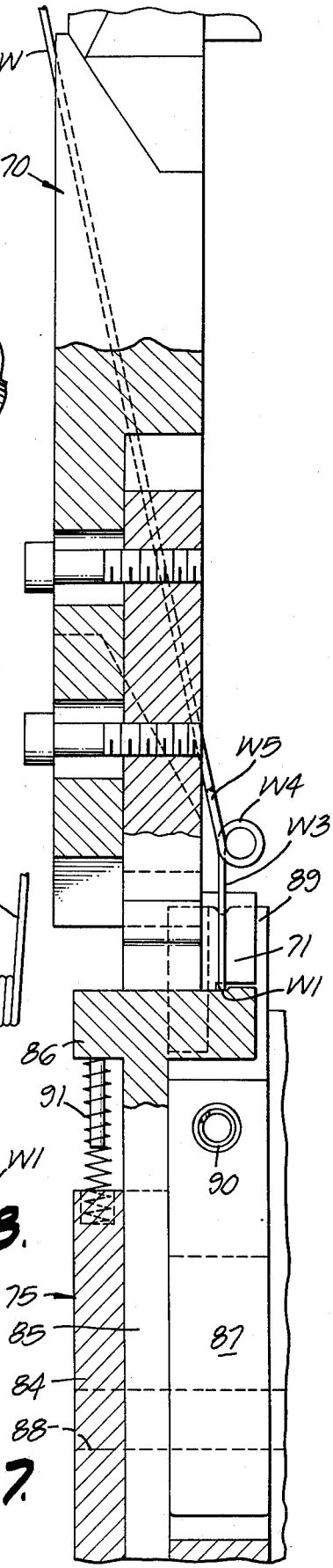
FIG. 17.

SPRING FORMING MACHINE

BACKGROUND OF THE INVENTION

Wire springs are formed in almost an infinite variety of shape and size. Also the number of springs that may be required in a line of products may be substantial. It is customary in the design of wire spring forming machines to make a special machine for a single size of spring or a relatively limited number. When attempt is made to expand the range of springs, the time required for change over from the manufacture of one spring to another is substantial.

SUMMARY OF THE INVENTION

The present invention is directed to a spring forming machine which overcomes the problems inherent in previous spring forming machines and which is summarized in the following objects:

First, to provide a spring forming machine which may be readily and quickly altered to form springs which vary substantially in shape and size, utilizing interchangeable forming components.

Second, to provide a spring forming machine, as indicated in the other objects, which utilizes a novel arrangement of drive means accessible from a plurality of locations for connection to the forming components.

Third, to provide a spring forming machine, as indicated in the other objects which utilizes an upright bed structure having a forward side provided with a plurality of mounting means and a set of clearance openings arranged in a circle and exposing a common main drive gear, and wherein the spring forming components have similar planetary gears permitting placement of any component in operating engagement with the main drive gear through any of the openings.

Fourth, to provide a spring forming machine, as indicated in the other objects, wherein the forming components may be arranged for direct drive connection with the main drive gear or provided with an electric, hydraulic or air drive activated by a switch or valve controlled by a cam driven by a planetary gear engaging the main gear.

DESCRIPTION OF THE FIGURES

FIG. 4 is an enlarged fragmentary sectional view taken through 4—4 of FIG. 1.

FIG. 5 is an enlarged fragmentary sectional view taken through 5—5 of FIG. 4.

FIGS. 10–15 are fragmentary views showing a typical succession of steps involving the operating elements of a plurality of wire bending assemblies as applied to the forming of a complex wire spring, requiring for its formation a series of bending operations.

FIG. 16 is a fragmentary sectional view taken through 16—16 of FIG. 12.

FIG. 17 is a fragmentary sectional view taken through 17—17 of FIG. 15.

FIG. 18 is a side view of the completed spring product, as formed by the elements displayed in FIGS. 10–17.

Figure 1:
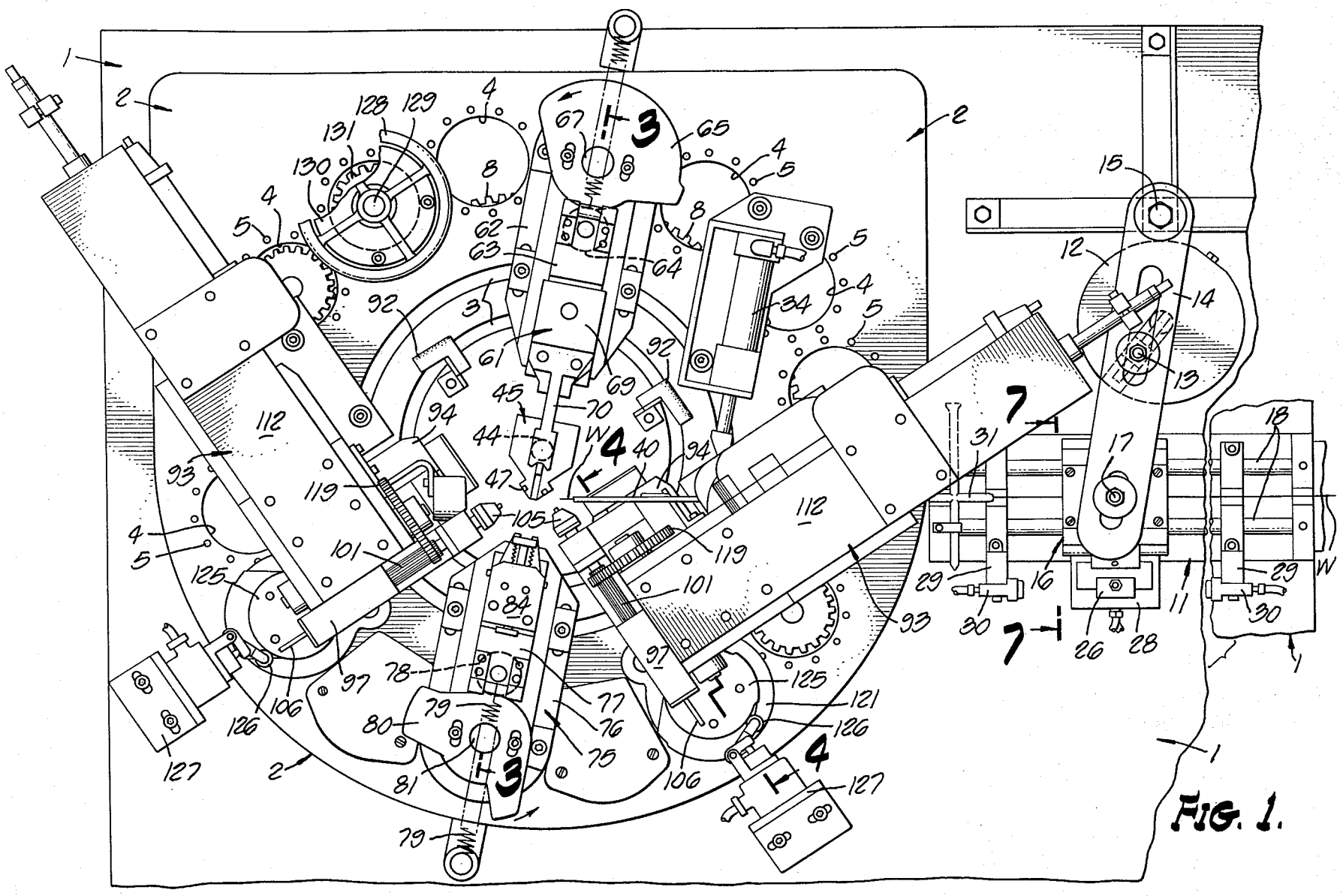
FIG. 1 is a front view of the spring forming machine with portions indicated fragmentarily.

References first directed to FIG. 1. The spring forming machine is carried by a mounting plate 1, suitably supported by means in an essentially vertical, or steeply inclined position. The mounting plate is provided with a relatively large opening which is covered by a main bed structure 2, secured by bolts 2*a*. The bed structure is provided with a pair of annular mounting channels 3, of T-shaped cross section. Surrounding the outer most mounting channel is a ring of clearance openings 4. In the structure shown, 16 such openings are provided. Each opening surrounded by a ring of screwthreaded mounting sockets 5.

Figure 2:
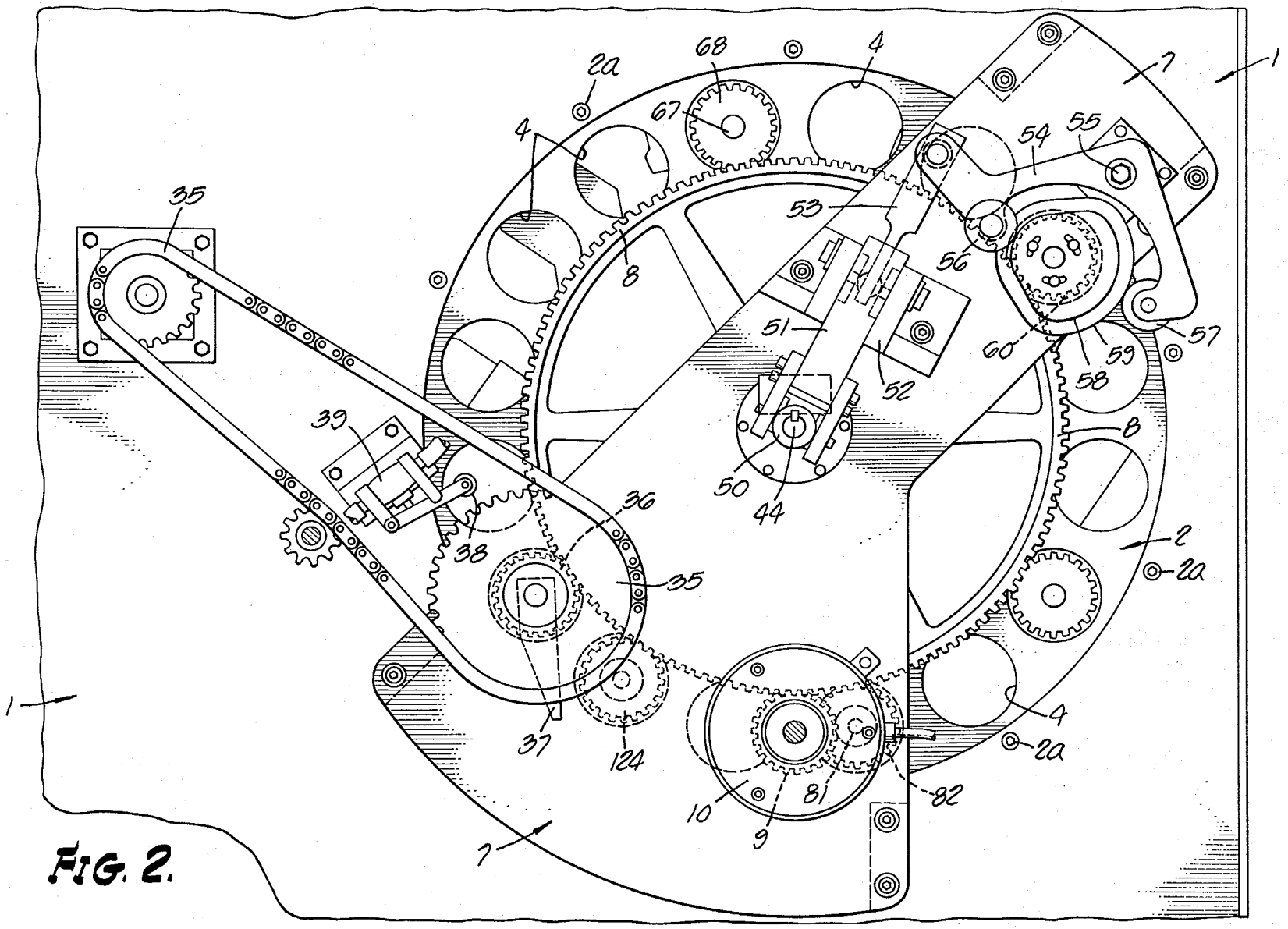
FIG. 2 is a back view thereof.
Figure 3:
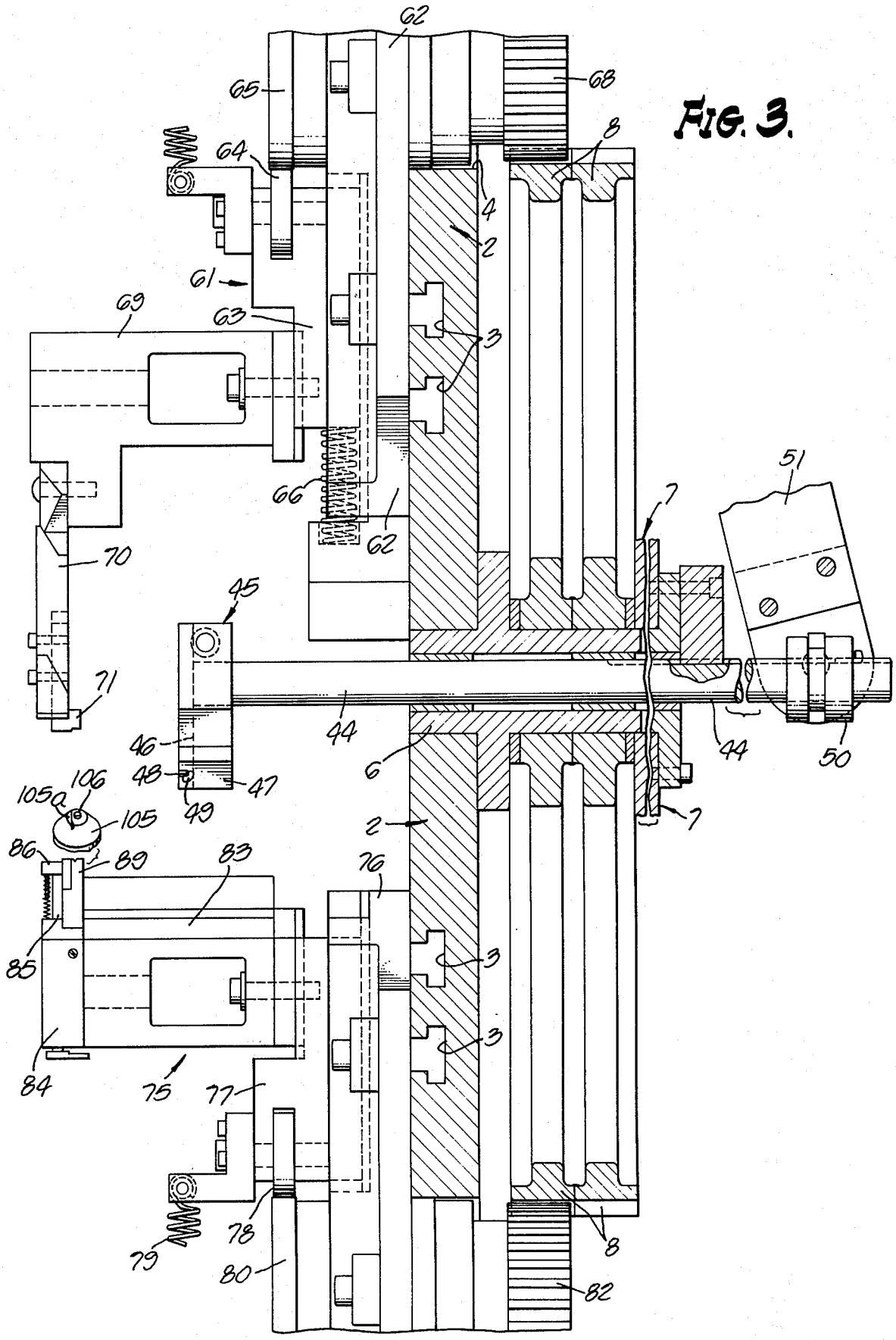
FIG. 3 is an enlarged fragmentary sectional view taken through 3—3 of FIG. 1.
Figure 6:
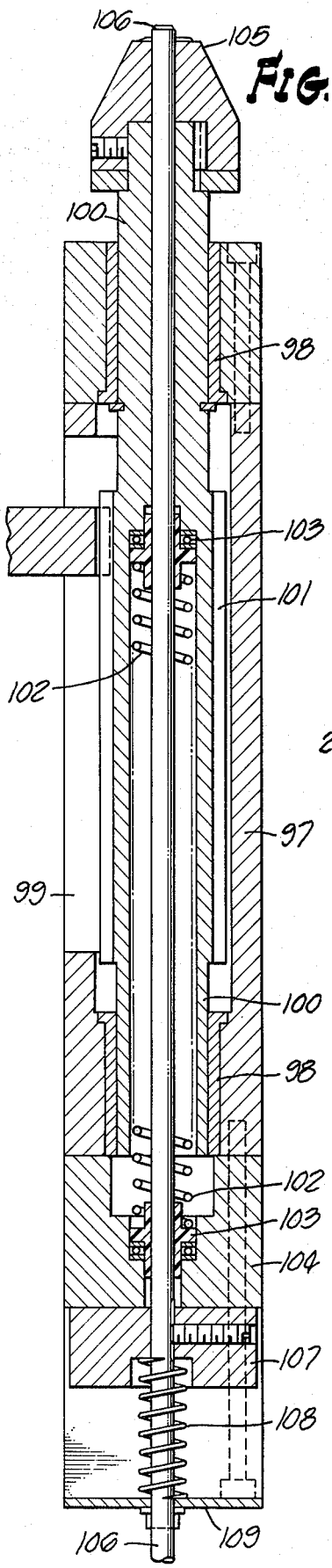
FIG. 6 is an enlarged longitudinal sectional view taken through 6—6 of FIG. 4, showing particularly one of the wire winding assemblies.

Centered with respect to the mounting channels 3 is a central bearing sleeve 6 extending rearwardly from the bed structure 2 as shown in FIGS. 2 and 3. Supported by the mounting plate 1 and extending across the backside of the main bed structure 2 is a mounting frame 7, which provides additional support for the sleeve 6. Journaled on a bearing sleeve 6 is a dual main drive gear 8, the periphery of which is exposed to the radially inner portions of the clearance openings 4. The main drive gear 8, is driven by a pinion gear 9, connected by a suitable electric clutch 10 to a drive motor not shown.

Mounted on the front side of the plate 1, at one lateral side of the main bed structure 2 is a wire feeding assembly 11, the wire feeding assembly includes a crank wheel 12 having a radially adjustable crank arm 13, which drives an oscillating lever arm 14 pivotly anchored at one end, as indicated by 15. The extended of the lever arm 14 ingages a carriage 16 through a drive pin 17. The carriage 16 is mounted on a pair of horizontally positioned guide rods 18.

Figure 7:
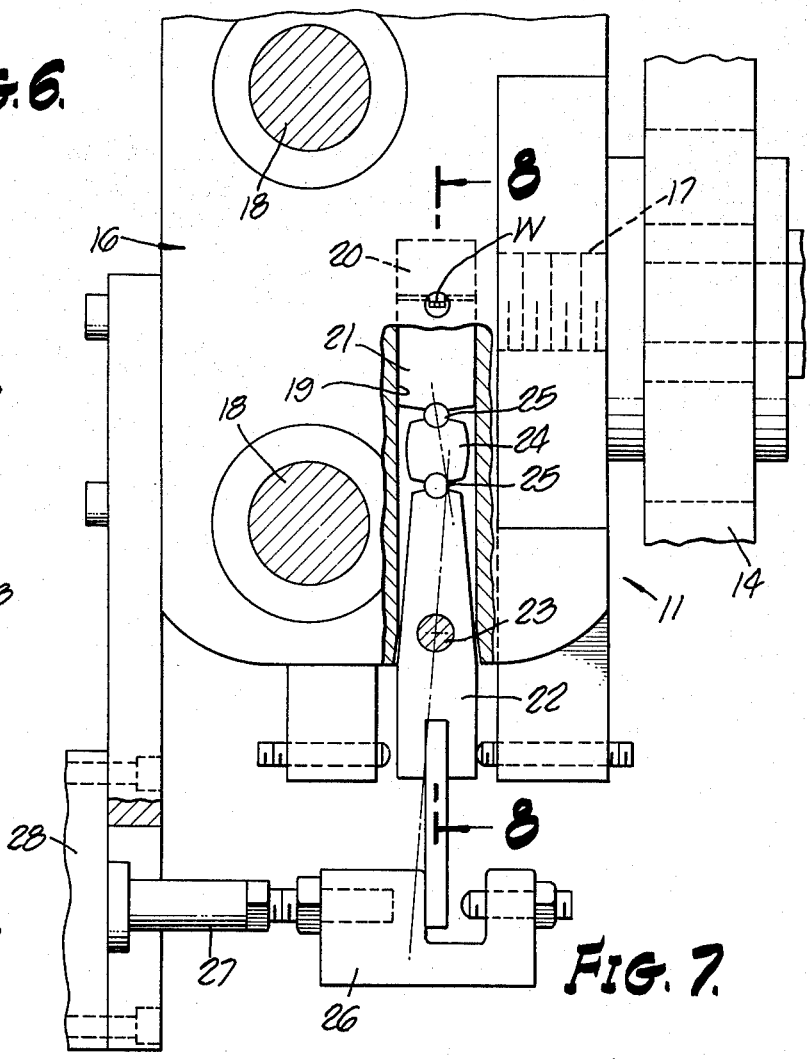
FIG. 7 is an enlarged fragmentary sectional view taken through 7—7 of FIG. 1, showing particularly the wire feeding mechanism.
Figure 9:
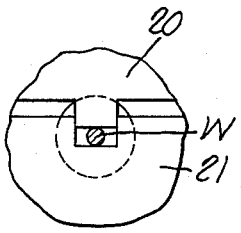
FIG. 9 is a fragmentary sectional view taken through 9—9 of FIG. 8.
Figure 8:
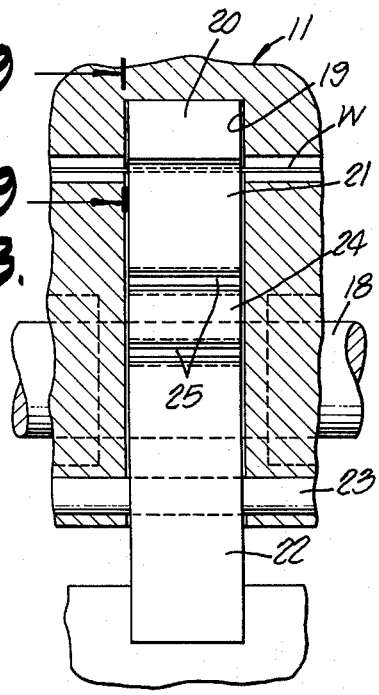
FIG. 8 is a fragmentary sectional view taken through 8—8 of FIG. 7.

As indicated in FIGS. 7, 8 and 9 the carriage 16 is provided with a socket 19 at the inner of which is mounted a fixed clamp element 20 engaged by a movable clamp element 21 slidable in a socket. At the outer portion of the socket there is journaled a toggle lever 22, mounted on a pivot pin 23. Between the toggle lever 22 and the movable clamp element 21 there is a force transmitting block 24, and a pair of force transmitting rollers 25 interposed between the block the movable clamp element 21 and the toggle lever 22. The outer end of the toggle lever 22 is engaged by a drive yoke 26, adjustably mounted on a shaft 27, which is movable by a solenoid 28.

The guide rods 18 are provided with a pair of adjustable stops 29, located at opposite sides of carriage 16, and provided with switches 30, which are engaged by the carriage. The clamp elements 20 and 21 are adapted to clamp a spring wire W. Disposed in parallel relation with the guide rods 18 and positioned to receive the spring wire W is an initial wire guide tube 31, which terminates at a guide surface 32 across which passes a cutoff blade 33, as shown in FIG. 10. The cutoff blade is operated by a hydraulic or pneumatic piston and cylinder unit 34 shown in FIG. 1. Mounted on the back side of the main bed structure 2 and mounting plate 1 is a drive sprocket and chain unit 35 which operates the crank wheel 12. The sprocket and chain unit 35 is driven by a planetary gear 36, which meshes with the main gear 8. The planetary gear 36 also drives a triggering arm 37 which engages a valve actuator 38, controlling a valve 39 which operates the piston and cylinder unit 34 to cause the blade 33 to sever the spring wire.

Referring to FIG. 10, continuing in alignment with the initial wire guide tube 31, is a slotted wire guide tube 40. Mounted on the main bed structure 2 is a wire positioning block 41 having a conical recess 42, in axial alignment with the guide tube 40. The block 41 is also provided with a slot 43.

Slidably mounted in the central bearing sleeve 6 is a thrust shaft 44, the forward end of which carries a wire forming block 45, shown in FIGS. 1 and 3. The wire forming block is provided with a centrally disposed downwardly directed slot 46, the lower of the block 45 forms a pair of angular surfaces 47, preferably at right angles. Each angular surface 47 includes a step having a retainer socket 48 and a wire wrapping lug 49 adjacent to the socket, as indicated in FIGS. 10 through 16.

Referring to FIG. 2, the rear end of the thrust shaft 44 is provided with a collar 50, which is engaged by a crank lever 51 pivotly mounted in a supporting bracket 52. The crank lever 51 is connected to a link 53, which in turn is connected to oscillating lever 54, mounted on a pivot support 55. The oscillating lever 54 is provided with a pair of cam rollers 56 and 57 which engage cams 58 and 59 mounted on a shaft driven by a pinion gear 60, which engages the main drive gear 8.

Referring to FIGS. 1 and 3, a first wire folding assembly 61 is mounted on the front side of the main bed structure 2, and includes a bed structure 62 secured to the main bed structure 2. The bed structure 62 is provided with guideways for a carriage 63 on which is mounted a cam roller 64 maintained in engagement with a cam 65 by appropriate springs 66. The cam 65 is mounted on a shaft 67, suitably supported in one of the clearance openings 4 and carrying a planetary gear 68 which engages the main drive gear 8.

The carriage 63 is provided with a bracket 69, which carries a stem 70 disposed parallel with the main bed structure 2. The stem 70 is provided with a wire folding tip 71, that is to be guided by the slot 46, in the wire forming block 45. The wire folding tip 71 is provided with opposite side notches 72. The lower end of the stem 70 forwardly of the tip 71 is provided with upwardly converging cam surfaces 73, as shown in FIGS. 10 through 15.

Mounted at the lower side of the main bed structure 2 is a second wire folding assembly 75, which includes a bed structure 76, secured to the main bed structure 2. The bed structure 76 is provided with a carriage 77, having a cam roller 78 maintained by the force of a spring 79 in engagement with a cam 80 mounted on a shaft 81, suitably supported in a clearance opening 4 and carrying a planetary gear 82, engageable with the main drive gear 8.

The carriage 77 is provided with a bracket 83. Mounted on the bracket 83 is a lever and slide bar support 84. Referring to FIGS. 15, 16 and 17 the support 84 forms a chamber having parallel front and rear walls. The front wall is provided with a channel which forms a guide for a slide bar 85 terminating in a head 86, which cooperates with a wire folding tip 71.

The chamber formed in the support 84 receives an opposed pair of levers 87, journaled on pins 88, the upper extremities of the levers form fingers 89, which engage the converging cam surfaces 73 to engage the wire W folded above the tip 71. A spring 90 urges the levers 87 in opposition to the cam surfaces 73 and springs 91 urge the slide bar 85 upwardly with respect to the support 84.

Mounted on the main bed structure 2 is a pair of stops 92 which engage the extremities of the spring wire W during the initial forming operation.

Mounted on the main bed structure 2 is a pair of wire winding assemblies 93, shown particularly in FIGS. 1, 4, 5 and 6. Each wire winding assembly includes a guide way structure 94, secured to the main bed structure 2, on which is slidably mounted a carriage 95, which supports a bracket 96.

The spindle housing 97 journals a wire winding spindle 100, having an elongated pinion gear 101, disposed between the bearings 98 and exposed to the side slot 99. The spindle 100 is counterbored to receive a thrust spring 102 disposed between thrust bearings 103, one of which bears against an end block 104, secured to the housing 97 and the other of which urges the spindle axially from the spindle bearing 97. The spindle 100 is provided at its exposed end protruding from the spindle housing 97, having wire wrapping lug 105*a* radially of the head 105. Slidably, as well as rotatably mounted, within the spindle 100 is a mandrel 105 which protrudes from the head 105. The opposite end of the mandrel 106 protrudes from the opposite end of the spindle housing and secured thereto is a disk 107. A thrust spring 108 is interposed between the disk 107 and a cap 109 secured to the end of the spindle housing 97.

A spindle drive unit 110 extends at right angles to the axis of the spindle housing 97 and its spindle 100. The spindle drive unit is supported by the mounting bracket 111, independently of but adjacent the bracket 96, as shown fragmentarily in FIGS. 4 and 5. The mounting bracket 111 carries a mounting plate 112. The spindle drive unit includes a fluid power means 113, secured under the mounting plate 112. The fluid means may be pneumatic or hydraulic, and includes a piston and cylinder from which extends a shaft secured to a rack 114, slidably movable in a guide block 115. The rack engages a pinion 116 mounted on a pinion shaft 117, supported by spaced bearings 118. The shaft 117 is provided with a transfer gear 119, which engages the elongated pinion gear 101.

The carriage 95, bracket 96, spindle housing 97 and wire winding spindle 100 are moved as a unit by means of a cam drive which includes a cam follower 120, carried by the bracket 96 and engageable with a cam 121 mounted on a shaft not shown, journaled in a housing 123, secured in alignment with one of clearance openings 4. The shaft is provided with a planetary gear 124, which engages the main drive gear 8. The shaft also carries a valve operating cam 125, which engages a cam follower 126 to operate a valve 127 for controlling the fluid power means 113.

The various wire forming assemblies do not utilize all of the clearance openings 4. Consequently as unused clearance opening 4 may be utilized for a hand operated wheel 128 mounted on a shaft 129 carried by a journal, one end of structure 130 and provided with a planetary gear 131 engageable with the main drive gear 8. Either or both ends of the shaft 129 may be provided with a hand wheel 128, to permit manual operation in order to check the functioning of the various wire forming assemblies.

It should be noted that while the machine is intended primarily for the forming of springs, whether they be formed of round, square or rectangular wire, the machine is also adaptable to the forming of wire products which may no be classified as springs.

The machine is intended to enable the formation of springs, having a wide range of size and shape, with a minimum loss of time in changeover from one size or shape of spring to another. For purposes of illustration, but without limiting the scope of this invention, several spring forming assemblies which could be used individually or in other combinations are assembled on the machine as shown. The wire spring product used for the purpose of illustration is shown in FIG. 18 and involves a central portion W1 folded at right angles at W2 to form substantially parallel portions W3 which are joined to coil portions W4, which terminate in a second pair of essentially parallel end portions W5. Operation of the machine to form a spring of this configuration is as hereinafter described.

The main drive gear 8 rotates continuously, and in doing so rotates the various pinion gears protruding through the clearance openings 4. Each cycle of operation is initiated by the carriage 16 engaging the right hand switch 30 as shown in FIG. 1, causing the solenoid 28 to force the movable clamp element 21 into clamping engagement with the wire W. Continued movement of the drive sprocket and chain 35 causes the carriage 16 to move to the left as viewed in FIG. 1, advancing the wire until the carriage 16 engages the left hand switch 30 whereupon the carriage 16 again moves to the right, free of the spring wire W.

Essentially simultaneous with engagement by the carriage with the left hand switch 30, the triggering arm 37 operating through the fluid unit 34 causes the cutoff blade 33 to sever the wire, this is the condition indicated by the broken line position of the cutoff blade in FIG. 10. The initial forming operation is indicated in FIG. 11. In this operation the wire folding tip 71 engages the head 86 to clamp the wire.

The two wire winding assemblies 93 are then operated. These assemblies are so mounted that when the first folding assembly 58 is in position to clamp the wire, the sockets 48 are in alignment with the mandrels 106 of the two wire winding spindle head 105, as shown in FIG. 12. The heads 105 are then rotated, causing the spring winding lugs 49 and 105*a* to engage and rotate the free ends of the wires about the mandrels 106, as shown in FIG. 13. During this operation the slide bar 85 and its head 86 are retracted so as to clear the rotating free extremities of the wire.

Upon completion of the wire wraping or coiling operation the head 86 again clamps the central portion W1 of the wire against the tip 71, as shown in FIG. 14, and the mandrels 106 and the heads 105 of the wire winding spindles 100 begin to retreat. Simultaneously, the fingers 89 engage the cam surfaces 73 forcing the fingers 89 to move inwardly engaging the portions W3 of the wire while the block 45 retreats, as shown in FIG. 15. Subsequent retraction of the wire folding assembly permits the finish wire to fall free. To facilitate this, the bed structure is tilted.

The wire forming assemblies illustrated may be used in different ways. If a simple coil spring is closed, one of the coiling assemblies 93 and the head 45 may be used. Also their positions may be changed if needed, and either or both assemblies may be modified or replaced depending upon the specifications of the coil spring required.

Similarly, if a U-shaped spring is desired, omitting the couls W4, the assemblies 61 and 75 may be used.

By providing a set of interchangeable forming assemblies, the time required to change the size and shape of spring to be produced, is minimized. Utilization of the T-channels 3 and the screwthreaded sockets 5 and appropriate assemblies, virtually any shape and size of wire spring product can be made.

By reason of the gear arrangement including the main gear and the pinion gears for individual operation of the forming assemblies synchronizing of the various operation is easily attained.

Having fully described my invention it is to be understood that I am not to be limited to the details herein set forth, and that my invention is of the full scope of the appended claims.

I claim:

1. A spring forming machine, comprising:

a. a plurality of spring forming assemblies including actuating means having axes disposed about a common center, each arranged to perform a preselected spring forming operation;

b. a bed structure having means for mounting each assembly in various positions about the axes of their respective actuating means for cooperation with other assemblies to form a selected wire product;

c. and a drive means disposed at the center common to the assembly actuating means to synchronize operation of the assemblies.

2. A spring forming machine, as defined in claim 1, wherein:

a. the bed structure includes a front side and a back side;

b. the common means is disposed at the back side of the bed structure;

c. and a ring of access openings are provided in the bed structure for connecting the assembly actuating means to the common drive means.

3. A spring forming machine, as defined in claim 2, wherein:

a. a spring feeding mechanism, connected to the common drive means is positioned at the front side of the bed structure laterally of the spring formation assemblies;

b. and one of the spring forming assemblies is a spring cut-off means.

4. A spring forming machine, as defined in claim 2, wherein:

a hand wheel is adapted to be removably mounted over a selected opening and engage the common drive means to effect manual operation of the forming assemblies.

5. A spring forming machine, as defined in claim 1, wherein:

a. the set of forming assemblies includes cooperating wire coiling assemblies.

6. A spring forming machine, as defined in claim 1, wherein:

a. the set of forming assemblies includes cooperating wire folding assemblies.

7. A spring forming machine comprising:

a. a bed structure including a front side and a back side connected by a ring of access openings, the front side having means for mounting wire spring forming units thereon;

b. a main drive gear at the back side of the bed structure the periphery thereof being accessible through the access openings;

c. a set of wire spring forming assemblies secured by said mounting means to the front side of the bed structure, each assembly including an actuating gear connected to the main drive gear through a corresponding access opening.

8. A spring forming machine, as defined in claim 7, wherein:

a. a wire spring feeding mechanism, driven from the main drive means, is positioned at the front side of bed structure laterally of the ring of openings;

b. guide means delivers the spring wire into position for engagement by the forming assemblies;

c. and one of the forming assemblies is a cut-off means interposed in the guide means.

9. A spring forming machine as defined in claim 7, wherein:

a. the set of forming assemblies includes cooperating wire coiling assemblies.

10. A spring forming machine as defined in claim 9, wherein:

a. the set of forming assemblies includes cooperating wire folding assemblies.

11. A spring forming machine as defined in claim 9, wherein:

a. selected forming assemblies include a fluid operated piston and cylinder means having a fluid supply valve operated by an actuating gear engaging the main drive gear.

12. A spring forming machine as defined in claim 8, wherein:

a. the set of forming assemblies includes a wire coiling assembly comprising an axially movable and rotatable coiling head; means for effecting axial movement of the coiling head including a cam follower, cam and cam shaft, the cam shaft being driven by an actuating means engaging the main drive means; and means for effecting rotation of the coiling head including a fluid power unit, rack and pinion drive, a second cam on said cam shaft, and valve means operated by said second cam.

13. A spring forming machine, comprising:

a. a bed structure having a ring of openings;

b. a main drive means having an axis sharing the common axis of the ring of openings;

c. a set of drive units each including a bearing means receivable within a selected opening, a shaft journaled therein and a driven means engageable with the main drive means;

d. a wire feeding assembly driven by one of the drive units and including a wire guide and cutoff means;

e. and a set of interchangeable wire spring forming assemblies individually connected to the other drive units.

14. A spring forming machine as defined in claim 13, wherein:

a. the set of forming assemblies includes cooperating wire coiling assemblies.

15. A spring forming machine as defined in claim 13, wherein:

a. the set of forming assemblies includes cooperating wire folding assemblies.

16. A spring forming machine as defined in claim 13, wherein:

a. at least one of the forming assemblies is a wire coiling assembly, including a coiling head connected to a first cam on the shaft of a corresponding drive unit for axial movement, and connected to a second cam on said shaft for rotational movement.

17. A wire forming machine, comprising:

a. a set of wire forming assemblies each adapted to perform a preselected wire forming operation and including a driven element;

b. a bed structure having a front side, a back side, a ring of openings communicating therebetween, and annular forming assembly mounting means on its front side within the ring of openings for securing the set of forming assemblies to the front side of the bed structure with their respective driven elements projecting through selected openings and forming a ring of driven elements accessible to the back side of the bed structure;

c. a main drive means centered within and engaging the ring of driven elements.

18. A wire forming machine, as defined in claim 17, wherein:

a. a hand wheel is adapted to be removably mounted over a selected opening and engage the main drive means to effect manual operation of the forming assemblies.

* * * * *